US005984795A

United States Patent [19]

Stafford

[11] Patent Number: 5,984,795

[45] Date of Patent: Nov. 16, 1999

[54] TRAINING GRIP FOR A GOLF CLUB

[75] Inventor: Joseph W. Stafford, Atlanta, Ga.

[73] Assignee: Seacoast Golf, L.L.C., Atlanta, Ga.

[21] Appl. No.: 09/240,393

[22] Filed: Jan. 29, 1999

[51] Int. Cl.[6] ..... A63B 69/36

[52] U.S. Cl. ..... 473/206; 473/299; 473/303

[58] Field of Search ..... 473/206, 298, 473/299, 303

[56] References Cited

U.S. PATENT DOCUMENTS

| | | | |
|---|---|---|---|
| D. 125,602 | 3/1941 | Wheeler et al. . | |
| D. 156,578 | 12/1949 | Strazza . | |
| 412,479 | 10/1889 | Davis . | |
| 1,664,257 | 3/1928 | McCullough . | |
| 1,855,126 | 4/1932 | Connell . | |
| 3,227,455 | 1/1966 | Hulsman | 473/206 |
| 4,592,109 | 6/1986 | Borea et al. | 15/172 |
| 4,617,697 | 10/1986 | David | 16/110 R |
| 5,299,802 | 4/1994 | Bouchet-Lassale | 273/81.4 |
| 5,524,892 | 6/1996 | Karp | 473/206 |
| 5,588,921 | 12/1996 | Parsick | 473/299 |
| 5,626,527 | 5/1997 | Eberlein | 473/203 |
| 5,729,864 | 3/1998 | Lie et al. | 16/110 R |

*Primary Examiner*—George J. Marlo
*Attorney, Agent, or Firm*—Bernstein & Associates, P.C.

[57] ABSTRACT

A training grip for positioning over a preexisting grip on a golf club shaft having an annular elongate resilient member with an open lower end, a cap on an upper end, and a longitudinal slit defined therein. The member has at least one groove for proper alignment on the club and an inner surface with a plurality of studs. At least two and preferably three contoured protrusions extend from the member for providing confirmation of proper hand position in the grip and providing abutments to discourage hand movement on the girip to enhance muscle memory. A plurality of contoured recessed portions are defined in the member for receiving and urging a user's hands into a proper position on the golf club, with the recessed portions having only a slight thickness to thereby enhance muscle memory. At least two openings are preferably defined in the member, for permitting gripping contact of the hands with the preexisting grip to assist in securing the grip to the preexisting grip. Tapered portions are provided on the member generally surrounding each of the openings.

19 Claims, 3 Drawing Sheets

TRAINING GRIP FOR A GOLF CLUB

CROSS REFERENCE TO RELATED DOCUMENTS

The present invention was the subject of Disclosure Document No. 442,819 filed Jul. 20, 1998, entitled "Golf Club Overgrip."

FIELD OF TITLE INVENTION

The present invention relates to golf training aids, and more particularly. to a training grip for installing over a preexisting grip on a golf club shaft to promote proper hand position on the club.

BRIEF DESCRIPTION OF THE PRIOR ART

Conventional teaching of the proper golf swing provides four fundamentals: stance, alignment, back and down swings, and grip. A proper hand grip is a learned skill that requires a high degree of exactness in the position of the hands on a golf club. Both hands must work together as one to produce a smooth, fluid motion in the golf swing. The proper grip is best learned by repeating the swing many many times with the hands in the exact same position every time. This develops precise muscle memory in the hands enabling the player to repeat the grip precisely and comfortably. thereby increasing the likelihood of striking the golf ball to obtain the desired ball flight.

The proper hand grip on the golf club is difficult to maintain because of torsional forces applied on and through the hands during the swing. Novice players often find it difficult to set up with the proper grip because of the number of other factors they attempt to assimilate into their swling. Even low-handicap players may find it difficult to maintain the proper grip during the swing through impact with the golf ball because they keep their eyes on the ball, not on their hands, and the torsional forces generated on their hands tend to cause their hands to move into a position other than what is proper and desired.

In order to promote proper hand positioning on the golf club, there have been developed a number of training grips with ridges and/or depressions providing for confirmation of hand positioning. Several known training grips, such as those disclosed by U.S. Pat. No. 1,664,257 to McCullough. U.S. Pat. No. Des. 125,602 to Wheeler et al., and U.S. Pat. No. 5,588,921 to Parsick. disclose golf club grips that are installed directly to the golf club shaft, as opposed to being installed over the preexisting grip, and have confirmation ridges and/or depressions contoured for fingers. These grips, however, are generally not readily installable on or removable from the club and are therefore generally more permanent in nature, so that a single grip generally can not be readily used with a variety of different golf clubs and the club can not be used for regulation play.

Other known training grips, such as those disclosed by U.S. Pat. No. 5,524.892 to Karp, U.S. Pat. No. 1,855,126 to Connell, and U.S. Pat. No. Des. 156,578 to Strazzaa. generally provide attachments to a preexisting grip on a golf club and have confirmation contours for one hand. These grips, however, often require attachment means such as screws or straps that may alter or damage the preexisting grip such that the club can not be used for regulation play, often provide confirmation for only one hand, and generally increase the weight and overall circumference of the grip resulting in diminished muscle memory.

Another known training grip is disclosed by U.S. Pat. No. 5,299.802 to Brouchet-Lassale, and provides an overgrip for a golf club having confirmation ribs and contours and a slit along the length. This grip, however, requires a fastener such as a clamp or a ring for securing to a preexisting grip, and has a thickness that increases the overall circumference of the grip resulting in diminished muscle memory of a user's hands.

Still another known training grip is disclosed by U.S. Pat. No. 5,626,527 to Eberlein. which provides an overgrip having two confirmation ridges and made of a thin material for unrolling down over a preexisting grip. This grip, however, is generally extremely elastic to permit rolling onto the grip and thereby generally insumficiently rigid to prevent torsional displacement of the ridges and hands oil the grip during the golf swing.

Accordingly what is needed but not found in the prior art is a training grip for a golf club having a one-piece unibody construction that can be quickly and easily installed over and removed from a wide variety of different preexisting grips that provides a confirmation mechanism for promoting proper positioning of both hands on the golf club, that does not noticeably to the hands increase the overall circumference of the grip to thereby enhance muscle memory and retain as much of the feel of the club as possible, and that does not slip or otherwise move relative to the preexisting grip during any portion of the golf swing.

SUMMARY OF THE INVENTION

Generally described, the present invention provides a training grip for a golf club, comprising an annular, elongate. resilient member having a longitudinal slit defined therein for positioning over a preexisting grip on the golf club shaft, at least two protrusions extending from the member, a plurality of recesses defined in the member and at least two openings defined in the member for permitting gripping contact of a user's hand with the preexisting grip to secure the member in position.

A preferred embodiment of the present invention provides the annular elongate, resilient member with an open lower end and a cap on an upper end. The member has an inner surface preferably having a plurality of studs extending therefrom for So engaging surface channels in the preexisting grip. Also, the member preferably has at least one longitudinal groove defined therein for alignment of the training grip with the preexisting grip.

The confirmation protrusions are provided for urging the user's hands into the proper position on the club and for abutting the fingers to discourage torsional movement of the hands on the grip. Preferably, a first protrusion is positioned on the member for interposition between a thumb and forefinger of a user's lower hand, a second of said protrusions is positioned on the member for interposition between a thumb and forefinger of a user's upper hand, and a third protrusion is positioned generally around the circumference of said annular elongate member generally adjacent to the first protrusion and has a recess defined therein adapted to receive the forefinger of the lower hand. Additional recessed portions are defined in the member for receiving and urging a user's hands into a proper position on the golfclub, with the recessed portions having an outer diameter only slightly greater than the outer diameter of the preexisting grip.

A first opening is defined in the annular elongate member generally opposite and above the first protrusion for permitting gripping contact of at least one finger of the lower hand with the preexisting grip. A second opening is defined in the annular elongate member generally opposite and above the second protrusion for permitting gripping contact of at least one finger of the upper hand with the preexisting grip. Tapered portions are provided on the member generally surrounding each of the openings to provide a smooth transition from the training grip the preexisting grip.

To install the grip, a player pries open the annular, elongate member at the slit adjacent the end cap, positions the end cap over the butt end of the club, and pries the member open along the rest of the slit and over the club working down the grip until the entire member is positioned over the preexisting grip of the golf club. The grip is properly oriented relative to the club face by aligning the grooves on the grip with markings provided on most conventional preexisitng olrips. Removal of the grip is accomplished by reversing the above steps. The grip may thereby be quickly and easily installed and removed from the golf club.

When using the grip, the combination of the protrusions, the recesses, and the openings promote proper hand positioning on the club and thereby enhance muscle memory in the hands. The openings further permit direct gripping contact of the hands to the preexisting grip, which complements the studs on the inner surface of the member, the snug fit of the grip over the preexisting grip, and the adhesive characteristic of the inner surface, to thereby prevent movement of the grip on the preexisting grip.

Accordingly, it is an object of the present invention to provide a training grip for a golf club that can be quickly and easily installed over a wide variety of different preexisting grips by providing an annular, elongate, resilient member with a longitudinal slit defined therein.

It is another object to provide a training grip that promotes proper positioning of both of a user's hands on the golf club by providing confirmation protrusions that nest between and brace the forelinger and thumb of each hand and recesses that complementarily receive the hands.

It is still another object to provide a training grip that fits over a precxisting grip without noticeably to the hands increasing the overall weight or circumferenlce of the grip to thereby enhance muscle memory, by providing recessed portions and openings with tapered portions in the annular, elongate, resilient member that receive the user's hands and only slightly increase the overall circumference of the club.

It is yet another object to provide a training grip that fits over a preexisting grip and is held securely to the preexisting, rip without the need for clamps, strapsor other attachment devices by providing openings in the annular, elongate. resilient member for permitting gripping contact by the user's hands to the preexisting grip.

These and other objects, features, and advantages of the present invention are discussed or apparent in the following detailed description of the invention, in conjunction with the accompanying drawings and the appended claims.

BRIEF DESCRIPTION OF THE DRAWINGS

The various features and advantages of the invention will be apparent from the attached drawings in which like reference characters designate the same or similar parts throughout the figures, and in which.

DETAILED DESCRIPTION OF THE PREFERRED EMBODIMENT

Figure 1:
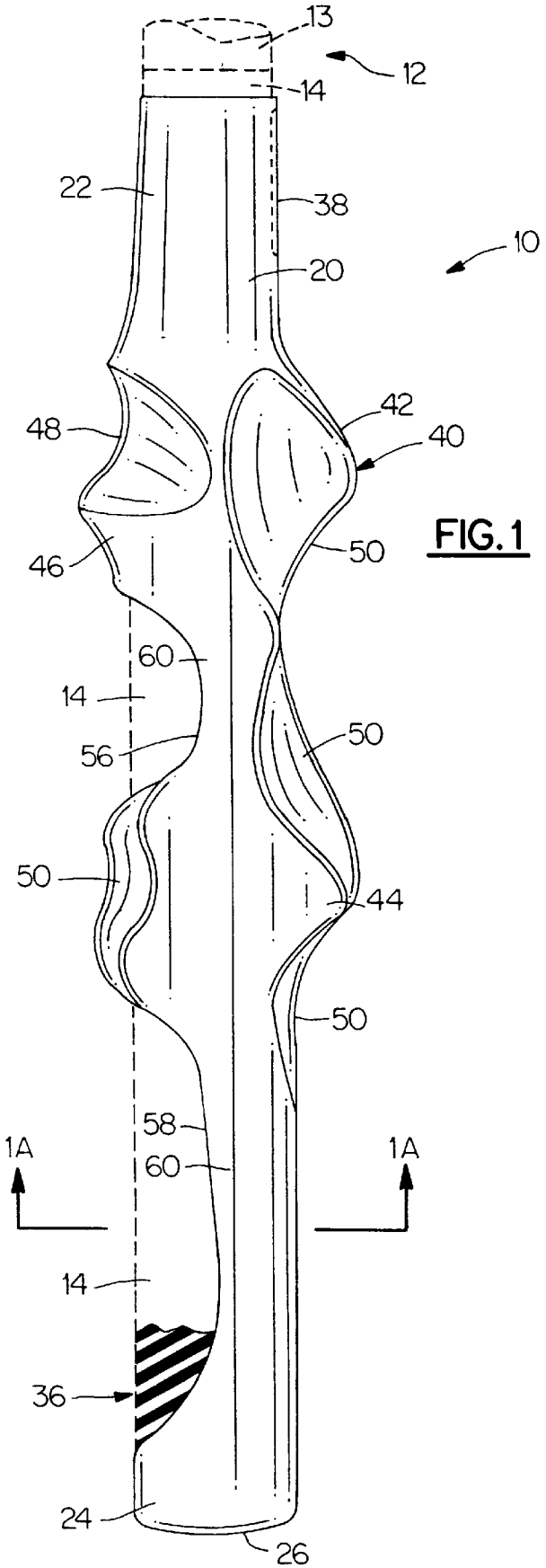
FIG. 1 is a left side view of a preferred embodiment of the present invention for a right-handed golfer.
Figure 2:
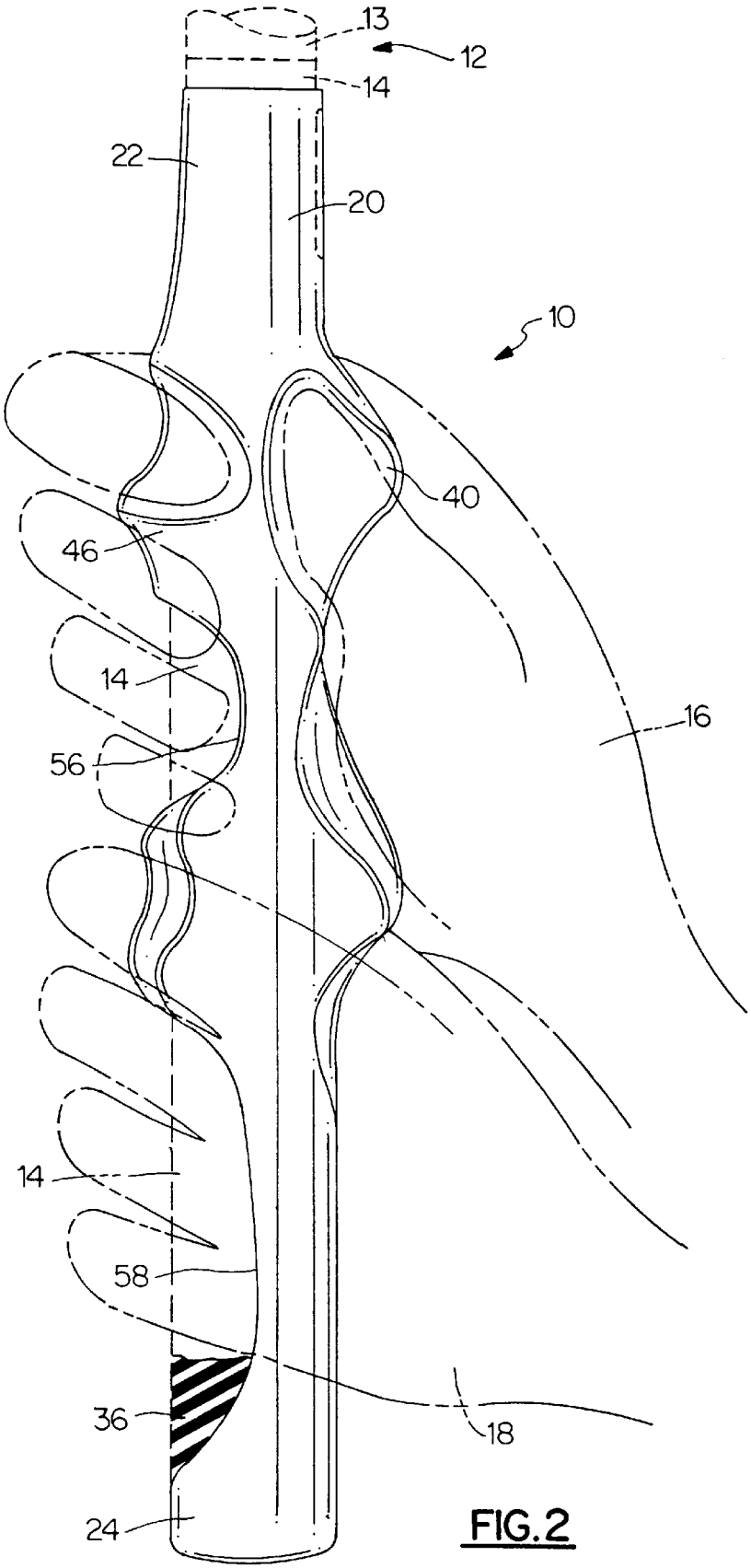
FIG. 2 is the left side view of FIG. 1, further showing hands gripping the invention.
Figure 3:
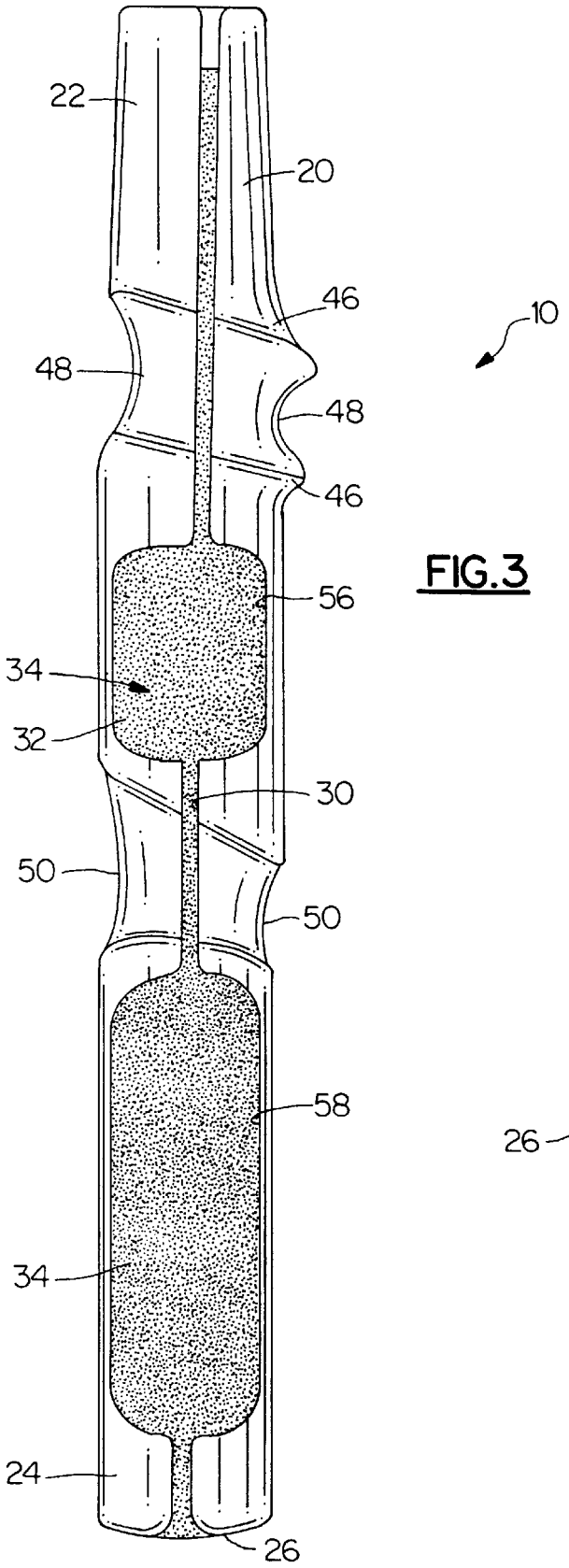
FIG. 3 is a rear side view of the preferred embodiment.

Referring now to FIGS. 1–3, there is illustrated a preferred embodiment of the present invention which provides a training grip 10 for a golfclub 12. The grip 10 is installed over a preexisting grip 14 on a shaft 13 of the club 12 for grasping by a user's lower hand 16 and upper hands 18. The grip 10 is preferably made of a resilient material such as an elastomeric or like compound having suufficient adhesive and/or frictional properties to prevent torsional movement of the user's hands 16, 18 when grasping the grip 10. The material is further selected to provide sufflcient resiliency to permit the grip 10 being flexibly manipulated for installation over a preexisting grip 14, and to also provide sufficient rigidity to substantially prevent any part of the grip 10 from torsionally moving relative to any other part of the grip 10. Moreover, a light-weight material is preferable so the weight of the club 12 is not noticeably different so as to promote muscle memory by maintaining the feel of the club 12. The grip 10 is preferably fabricated by extrusion molding or other techniques known to those skilled in the art to provide a one-piece unibody construction.

Figure 3A:
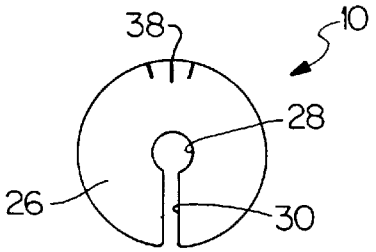
FIG. 3A is a plan view of the upper end of the preferred embodiment.

The grip 10 is provided with an annular elongate member 20 having a lower end 22 and an upper end 24. The lower end 22 is open, the upper end 24 terminates in a cap 26 with an aperture 28 defined therein, and the member 20 has a longitudinal slit 30 defined therein and preferably substantially coextensive with the member 20. The annular elongate member 20 may thereby be pried open along the slit 30 and positioned over the preexisting grip 14. with the golf club shaft 13 extending through the open lower end 22 and the cap 26 of the upper end 24 abutting with the end of the club shaft 13. The slit 30 preferably extends through the cap 26 and intersects with the aperture 28 (see FIG. 3A), to accommodate a preexisting grip 14 with a flared end without tearing or splitting the upper end 24. The upper end 24 thereby provides a grabbing action on the flared end of a preexisting grip 14.

The annular elongate member 20 has an inner surface 32 with a diameter sized to fit snugly over the preexisting grip 14. The inner surface 32 preferably has a plurality of studs 34 extending therefrom for engaging with surface channels 36 in the preexisting grip 14 to assist in securing and preventing movement of the grip relative to the preexisting grip 14. The studs 34 may be provided on the inner surface 32 by a fine tread, a grating, a series of ribs, a coarse texture, or by the use of other textured surfaces as known to those skilled in the art. Optionally. the inner surface 32 may have a layer provided with a grit material, an adhesive material, or another material selected for providing adherence of the inner surface 32 to the preexisting grip 14. The grip 10 may thereby be used with most conventional preexisting grips 14, including those having an additional covering such as cloth, leather, tape, or the like.

As shown in FIG. 3, the annular elongate member 20 preferably has at least one longitudinal groove 38 or like generally permanent marking defined thereon for alignment of the grip 10 with a marking (not shown) on the preexisting grip 14 and/or the face of the club 12. lreferably, three grooves 38 are provided (see FIG. 3A), with one groove 38 for aligning the grip 10 square with the face of the club 12 for a user with a neutral grip, and second and third grooves 38 for aligning the grip 10 in a position rotated slightly in either direction from square for a user with a strong or weak grip.

At least two and preferably three contoured protrusions 40, 44, 46 are provided extending from the annular elongate member 20 to provide confirmation of proper positioning of the hands 16, 18 on the grip 10 and to provide abutments preventing torsional movement of the hands 16, 18 on the (grip 10, thereby enhancing precise muscle memory for both hands 16, 18. Preferably, a first protrusion 40 is positioned on the annular elongate member 20 for interposition between a thumb and forefinger of the user's lower hand 16. The first protrusion 40 is generally wedge-shaped with a generally thin crest portion 42. Preferably. a second protrusion 44 is positioned on the annular elongate member 20 for interposition between a thumb and forefinger of the user's upper hand 18. The second protrusion 44 is generally wedge-shaped. Preferably, a third protrusion 46 is positioned generally around the circumference of the annular elongate member 20 generally adjacent to said first protrusion 40. A contoured recess 48 is defined in the first protrusion 40 generally coextensive therewith around the circumference of the annular elongate member 20 and generally U-shaped to receive the forefinger of the lower hand 16.

Additional contoured recessed portions 50 arc defined in the annular elongate member 20 for receiving the user's hands 16, 18 in the proper position on the grip 10. The recessed portions 50 are formed in shape and number so as to provide contours for complementarily engaging contours of the user's hands 16,18. The annular elongate member 20 has a minimal thickness at the recessed portions 50, such that the outer diameter 52 of the member 20 at the recessed portions 50 is only slightly greater than the outer diameter 54 of the preexisting grip. This minimal thickness of the member 20 where the hands 16, 18 are received enhances muscle memory by providing the grip 10 with a circumference only slightly greater than the circumference of the preexisting grip 14 on the club 12.

At least two openings 56, 58 are defined in the annular eloniate member 20 to provide locations for direct gripping contact of the hands 16, 18 with the preexisting grip 14. A first opening 56 is preferably defined in the member 20 generally opposite and above the first protrusion 40, thereby permitting gripping contact of at least one finger of the lower hand 16 (in this embodiment, the right hand) with the preexisting grip 14. A second opening 58 is defined in the member 20 generally opposite and above the second protrusion 44, thereby permitting gripping contact of at least one finger of the upper hand 18 (in this embodiment, the left hand) with the preexisting grip 14. Tapered portions 60 of the member 20 are provided generally surrounding each of the openings 56, 58 to provide a smooth transition from the grip 10 to the preexisting grip 14 and thereby match the contour of the grip 10 to the cointour of the hands 16, 18 as closely as possible. The tapered portions 60 thus assist in promoting a feel to the hands 16, 18 of the grip 10 that is consistent with the original feel of the club 12.

Figure 1A:
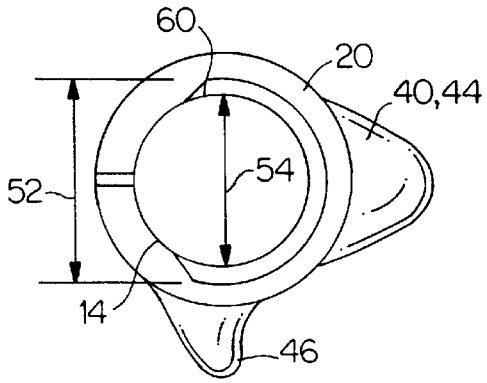
FIG. 1A is a cross-sectional side view of the preferred embodiment taken at line A—A.

The first and second openings 56, 58 are each preferably sufficiently large for gripping contact with three fingers of each of the respective lower and upper hands 16, 18. In the conventionally accepted proper golf grip, the two middle fingers adjacent the forefinger of the upper hand 18 cooperate with the hand 18 to grasp the club 14, and the second opening 58 preferably permits gripping contact of these two fingers with the preexisting grip 12. The openings 56. 58 preferably extend generally around about half the circumference of the member 20 such that a cross-section of the annular elongate member 20 taken therethrough provides generally a semi-circle (see FIG. 1A), thereby permitting gripping contact with a substantial part of each contacting finger and with the pads of the hands 16, 18 and the base of the contacting fingers. Optionally, the openings 56, 58 may be sized to permit gripping contact with only one or more finger, with only the fingertips of any contacting fingers, or with only the middle finger pads of any contacting fingers.

To install the grip 10, a player pries open the annular, elongate member 20 at the slit 30 adjacent the upper end cap 26, positions the end cap 26 over the butt end of the golf club 12, and pries the member 20 open along the rest of the slit 30 and over the club 12 working down the grip 10 until the entire member 20 is positioned over the preexisting grip 14 of the golf club 12. The grip 10 is properly oriented relative to the face of the club 12 by aligning( the grooves 38 on the grip 10 with markings provided on most conventional preexisting grips 14. Removal of the grip 10 is accomplished by reversing the above steps. The grip 10 may thereby be quickly and easily installed and removed from the golf club 12. Because the grip 10 is so readily installed and removed, the single grip 10 may be used on a number of different clubs 12. Also, the grip 10 may be used more fiequenitly than only when playing or practicing golf for even greater enhancement of muscle memory. For example, the grip 10 may be used at home while watching television programs such a golf tournaments, the grip 10 may be used on business or leisure trips, and/or the grip 10 may be used indoors over the winter months when weather conditions do not permit playing golf.

When using the grip 10, the combination of the protrusions 40, 44, 46, the recesses 48, 50, and the openings 56, 58 provide confirmation of proper positioning of the hands 16, 18 on the grip 10, provide abutments preventing torsional movement of the hands 16, 18 on the grip 10, and provide the grip 10 with an overall circumference only slightly greater than the circumference of the preexisting grip 14 on the club shaft 13 to thereby enhance muscle memory in the hands 16, 18. The combination of the direct gripping contact of the hands 16, 18 to the preexistingy grip 14 through the openings 56, 58, the studs 34 on the inner surface 32 of the member 20 engaging channels 36 on the preexisting grip 14, the snug fit of the grip 10 over the preexisting grip 14, and the adhesive characteristic of the inner surface 32 thereby secure the grip 10 firmly in place over the preexisting grip 14 to prevent movement of the grip which would otherwise be caused by torsional forces generated during the golf swing.

The grip 10 as described heretofore and in the drawings provides for use by a right-handed user. The grip 10 may also be provided for use by a left-handed user by providing the protrusions 40, 42, 46, the recesses 48, 50, and the openings 56. 58 in a reverse, mirror-image arrangement. The size and shape of the annular elongate member 20, the protrusions 40, 44, 46 the recesses 48, 50, and the openings 56, 58, may be varied for different hand sizes and shapes, such as to accommodate women and/or juniors. Additionally, the size and shape of the member 20 and the contours of the protrusions 40, 44, 46 and the recesses 48, 50 may be adapted to provide a grip for other sports articles, such rackets hockey sticks, baseball bats, and other sports involving the gripping of an article.

Accordingly, there arc a number of advantages provided by the present invention. The annular, elongate, resilient member 20 with the longitudinal slit 30 defined therein provides the advantage of a training grip 10 for a golf club 12 that can be quickly and easily installed over a wide variety of different preexisting grips 14.

Also, the at least two confirmation protrusions 40, 44 nest between and brace the forefinger and thumb of each hand 16, 18 and the recesses 48, 50 complementarily receive the hands, thereby providing the advantage of a training grip 10 that promotes proper positioning of both of a user's hands 16, 18 on the golf club 12.

Further more, the recessed portions 48, 50 and openings 56, 58 with tapered portions 60 in the annular, elongate, resilient member 20 complementarily receive the user's hands 16, 18 and only slightly increase the overall circumference 52 of the grip 10, thereby providing the advantage of a training grip 10 that fits over a preexisting grip 14 without noticeably to the hands 16, 18 increasing the overall weight or circumference of the grip 14 to thereby enhance muscle memory and retain as much of the feel of the club 12 as possible Moreover, the openings 56, 58 in the member 20 permitting gripping contact by the user's hands 16, 18 to the preexisting grip 14, thereby providing the advantage of a training grip 10 that fits over a preexisting, grip 14 and is held securely thereto without the need for clamps, straps, or other attachment devices so the grip 10 does not slip or otherwise move relative to the preexisting grip 14 during any portion of the golf swing.

While the invention has been described in connection with certain preferred embodiments, it is not intended to limit the scope of the invention to the particular forms set forth, but, on the contrary, it is intended to cover such alterniatives, modifications, and equivalents as may be included within the true spirit and scope of the invention as defined by the appended claims. All patents, applications and publications referred to herein are hereby incorporated by reference in their entirety.

What is claimed is:

1. A training grip for a conventional golf club, comprising:

a) an annular elongate member having a longitudinal slit defined therein, for positioning over a preexisting grip on said golf club shaft;

b) at least two contoured protrusions extending from said annular elongate member;

c) a plurality of contoured recesses defined in said annular elongate member; and d) at least two openings defined in said annular elongate member for permittinig gripping contact of a user's hand with said preexisting grip to secure said annular elongate member in position.

2. The training grip of claim 1, wherein said annular elongate member has an open lower end and an upper end, said upper end terminating in a cap.

3. The training grip of claim 1, wherein said annular elongate member has an inner surface having a plurality of spaced apart studs extending therefrom for engaging said preexisting grip.

4. The training grip of claim 1, wherein said annular elongate member has at least one longitudinal groove defined therein for alignment of said training grip with said preexisting grip.

5. The training grip of claim 1, wherein said annular elongate member is formed from a resilient material.

6. The training grip of claim 1, wherein said at least two protrusions and said plurality of recesses are adapted to maintain a user's hands in a proper position on said golf club.

7. The training grip of claim 6, wherein said recesses define portions of said annular elongate member capable of receiving and urging a user's hands into a proper position on said golf club, said recessed portions having an outer diameter only slightly greater than said outer diameter of said preexisting grip.

8. The training grip of claim 7, wherein a first of said protrusions is positioned on said annular elongate member for interposition between a thumb and forefinger of a user's lower hand, and a second of said protrusions is positioned on said annular elongate member for interposition between a thumb and forefinger of a user's upper hand.

9. The training grip of claim 8, wherein said first protrusion is generally wedge-shaped with a generally thin crest portion.

10. The training grip of claim 8, wherein a first of said openings is defined in said annular elongate member generally opposite and above said first protrusion for permitting gripping contact of at least one finger of said lower hand with said preexisting grip.

11. The training grip of claim 8, wherein a second of said openings is defined in said annular elongate member generally opposite and above said second protrusion for permitting gripping contact of at least one finger of said upper hand with said preexisting grip.

12. The training grip of claim 8, further comprising a third protrusion having a recess defined therein and positioned generally around the circumference of said annular elongate member generally adjacent to said first protrusion and adapted to receive said forefinger of said lower hand.

13. The training grip of claim 1, wherein said annular elongate member has tapered portions generally surrounding each of said at least two openings.

14. The training grip of claim 10, wherein said annular elongate member has tapered portions generally surrounding each of said at least two openings.

15. A training grip for a golf club, comprising:

a) an annular elongate member having an open lower end, a cap on an upper end, and a longitudinal slit defined therein, for positioning over a preexisting grip on a golf club shaft;

b) at least three contoured protrusions extending from said annular elongate member, a first of said protrusions positioned on said annular elongate member for interposition between a thumb and forefinger of a user's lower hand, a second of said protrusions positioned on said annular elongate member for interposition between a thumb and forefinger of a user's upper hand, and a third of said protrusions having a recess defined therein and positioned generally around the circumference of said annular elongate member generally adjacent to said first protrusion and adapted to receive said forefinger of said lower hand;

c) a plurality of contoured recessed portions defined in said annular elongate member, said recessed portions capable of receiving and urging a user's hands into a proper position on said golf club, said recessed portions having an outer diameter only slightly greater than said outer diameter of said preexisting grip; and d) at least two openings defined in said annular elongate member a first of said openings defined in said annular elongate member generally opposite and above said first protrusion for permitting gripping contact of at least one finger of said lower hand with said preexisting grip, a second of said openings defined in said annular elongate member generally opposite and above said second protrusion for permitting gripping contact of at least one finger of said upper hand with said preexisting grip, and tapered portions of said annular elongate member generally surrounding each of said at least two openings.

16. The training grip of claim 15, wherein said annular elongate member has an inner surface having a plurality of spaced apart studs thereupon for engaging said preexisting grip.

17. The training grip of claim 15 wherein said annular elongate member has at least one longitudinal groove for alignment of the training grip with said preexisting grip.

18. The training grip of claim 15, wherein said annular elongate member is formed from a resilient material.

19. The training grip of claim 15, wherein said first protrusion is generally wedge-shaped with a generally thin crest portion.

* * * * *